US005337593A

United States Patent [19]

Yano

[11] Patent Number: 5,337,593

[45] Date of Patent: Aug. 16, 1994

[54] EXTRUSION DIE AND AN EXTRUSION METHOD USING SAME

[75] Inventor: Sadahide Yano, Osaka, Japan

[73] Assignee: Yugen Kaisha Yano Engineering, Osaka, Japan

[21] Appl. No.: 42,723

[22] Filed: Apr. 5, 1993

[30] Foreign Application Priority Data

Apr. 17, 1992 [JP] Japan ..... 4-97950
Jul. 6, 1992 [JP] Japan ..... 4-178083

[51] Int. Cl.[5] ..... B21C 25/02
[52] U.S. Cl. ..... 72/269; 72/467
[58] Field of Search ..... 72/264, 269, 467, 478

[56] References Cited

U.S. PATENT DOCUMENTS 2,366,344 10/1940 McFadden .
3,918,288 11/1975 Verduzco et al. ..... 72/467
5,152,163 10/1992 Hawkes et al. ..... 72/269

FOREIGN PATENT DOCUMENTS 957977 11/1974 Canada ..... 72/269
398747 11/1990 European Pat. Off. .
2936506 4/1980 Fed. Rep. of Germany .
130214 6/1988 Japan ..... 72/467
247012 10/1990 Japan ..... 72/269
1109871 4/1968 United Kingdom .
1400642 7/1975 United Kingdom .

OTHER PUBLICATIONS

Patent Abstracts of Japan, No. JP62238016 vol. 012109, Application No. JP860083092, Apr. 1988.

*Primary Examiner*—Lowell A. Larson
*Attorney, Agent, or Firm*—Collard & Roe

[57] ABSTRACT

A female die 3 is composed of a plate-shaped bearing tip 31, a backup block 32 and a cylindrical holder 33 for receiving and setting in place the tip together with the block, in which the bearing tip 31 made of a hard metal and the backup block 32 also made of the hard metal are such that they can be manufactured simply and easily, and in which only the bearing tip 31 need be replaced with a new one if and when the bearing portion of the die has been abraded.

12 Claims, 18 Drawing Sheets

EXTRUSION DIE AND AN EXTRUSION METHOD USING SAME

BACKGROUND OF THE INVENTION

1. Technical Field of the Invention

The present invention relates to an extrusion die such as a solid die or the so-called "port-hole" die, which are adapted for use in extruding small-, medium- or large-sized articles such as the multi-bored flat tubes in a heat exchanger made of aluminum or its alloy, and also the present invention relates to a method of extruding such articles by using the extrusion die.

2. Prior Art

FIG. 17 shows an example of aluminum tubes which constitute a heat exchanger employed for instance in the air conditioning system. Among the various methods of manufacturing such a tube 1, the extrusion method is advantageous in that a high pressure resistance can be enhanced to the tube.

The die assembly, for example the "port-hole" die, used to extrude the tubes does comprise in general a male die 51 mating a female die 52 as shown in FIG. 19*a*. The male die forms a hollow space extending through and longitudinally of the tube 1, whereas the female die forms a periphery of said tube.

FIGS. 19*a* and 20 illustrate the prior art female die 52 which is an integral piece made of a die steel. This female die has a recess 53, a central bearing hole 54 and a bell-shaped portion 55 which are arranged close to and in axial alignment with one another. The recess 53 provides a fusion chamber, and the bearing hole 54 directly contributes to the control of extrusion process.

A circumferential edge defining the bearing hole 54 will be abraded and worn out as the extrusion process is repeated. The one-piece female die 52 has to be replaced as whole with a new one, thereby undesirably raising the running cost of the extrusion process, especially where the medium- or large-sized die is used.

The tubes 1 for the heat exchanger are so small and so precise that the bearing hole tends to be deformed due to a high pressure of the extruded material. Therefore, it has been difficult to continuously ensure a high precision in shape and dimension of the flat tubes 1 such as shown in FIG. 17, in which their width "B" and height "H" are 10–20 mm and 3–7 mm, respectively. Similar problem of the impaired accuracy in shape and dimension is also found when extruding the medium- or large-sized articles.

has been proposed to make the female die 52 from a hard material such as a ceramics or a hard metal (that is "cemented carbide"). The female die made of such a material might be more resistant to abrasion and the frequency of changing the female die would be reduced. Further, the deformation of the die during the extrusion process would also be diminished to manufacture the tubes 1 of a higher precision in their dimension and shape.

Since the ceramics and the hard metal are however too expensive, it has not been feasible to supply the female die 52 at a reasonable price. In case of the medium-or large-sized die, its material cost would be raised to an almost intolerable extent.

SUMMARY OF THE INVENTION

A first object of the present invention made to resolve the aforementioned problems is therefore to provide an extrusion die and an extrusion method which render less expensive the change or renewal of an abraded die whose bearing portion has been worn out so that the extrusion process can be carried out at a lowered running cost, wherein the extrusion die defining the outer periphery of an extruded article may be a female die in the combination die assembly as referred to above or a solid die used to extrude a columnar article.

Another object of the invention is to provide such an extrusion die and an extrusion method that are effective not only to achieve the first object but also to manufacture an extruded article of a higher precision in its shape and dimension.

In order to achieve these objects, the present invention provides an extrusion die which comprises a bearing tip having such a central forming hole as determining the outer periphery of an extruded article, and a supporting mold for holding the bearing tip in place, wherein the tip and the mold are separable from one another.

The bearing tip may preferably be made of a thin flat plate having a thickness substantially corresponding to the bearing axial length of the central hole.

The supporting mold may preferably comprise a backup block and a cylindrical holder, wherein the cylindrical holder receives the bearing tip together with the backup block disposed behind and close to the bearing tip.

It is desirable that the bearing tip is made of a hard material such as a hard metal or ceramics.

It is also desirable that the backup block is similarly made of a hard material such as the hard metal (i.e., cemented carbide) or ceramics.

The bearing tip may have noncircular contours, and correspondingly, the inner periphery of a tim receiving bore of the cylindrical holder may also be noncellular so as to engage with the tip and keep it at a correct angular position.

Alternatively or additionally, one or more pins may be employed to position the bearing tip correctly relative to the backup block which may, in this case, be shrinkage-fitted in the cylindrical holder.

Alternatively, the backup block may have on its rearward (i.e., "upstream" in the sense of the extruded flow) end surface a noncircular recess in which the bearing tip can be secured.

In another preferable mode of the invention, an extrusion die comprises a bearing tip having such a central forming hole as determining the outer periphery of an extruded article, and a supporting mold for holding in place the bearing tip separable from the mold, the supporting mold having a tip-insertion hole formed with a rearward opening and a forward bottom so that the bearing tip is inserted forwardly through said opening so as to rest on the bottom, wherein the tip-insertion hole comprises a guiding region extending forwards from the rearward opening and a gripping region which is formed as a forward end of said guiding region so as to tightly hold the inserted bearing tip, and wherein the guiding region has an inner periphery tapered such that its diameter reduces towards the gripping region which has a non-tapered inner periphery closely fittable on a non-tapered outer periphery of the bearing tip.

The bearing tip in this case may also preferably be made of a thin flat plate having a thickness substantially corresponding to the bearing axial length of the central hole.

Also, the supporting mold in this case may comprise a backup block in rear of the bearing tip, a metal-flow controlling spacer in front of the backup block, and a cylindrical holder for receiving said block together with said spacer.

It is further desirable that the rearward end surface of the backup block serves as the bottom of the tip-insertion hole, which hole is in this case an axial bore through the metal flow-controlling spacer.

The bearing tip and said spacer are also made of a hard material such as the aforementioned hard metal or ceramics.

It will be understood that the extrusion die for forming the outer periphery as summarized above may further comprise a male die for forming an inner periphery of the extruded article, to thereby construct a combination die. The male die in such a combination die may comprise: a core having at its inner (i.e., forward) end at lease one projected portion of such a shape as defining the inner periphery; the core further having at least one pierced opening through, or engraved recess on, a body portion of the core; at least one stopping member disposed through the opening or in the recess of the core such that at least one side end of the stopping member protrudes sideways from the side surface of the body portion; a male mold having a core-holding aperture which is formed through the male die so as to extend from an outer extremity to an inner extremity thereof; and at least one shoulder formed on an inner wall surface of the core-holding aperture so as to face the male die's outer extremity disposed upstream of the extruded flow, wherein the core is inserted in the core-holding aperture such that the at least one side end of the stopping member is born by the at least one shoulder so as to retain the core in the male mold.

From another aspect of the present invention, it provides a method of extruding a metallic material by using an extrusion die which comprises a bearing tip having such a central hole as determining the outer periphery of an extruded article, and a supporting mold for holding the bearing tip in place, wherein the tip and the supporting mold are separable from one another.

Further objects and advantages of this invention will become clear in the embodiments which will be given hereinafter only by way of examples to demonstrate the preferred modes. Therefore, this invention is not limited to those embodiments but permits many other modifications falling within the range and spirit of the invention.

BRIEF DESCRIPTION OF THE DRAWINGS

The accompanying drawings illustrate some embodiments of the present invention, in which.

DETAILED DESCRIPTION OF THE PREFERRED EMBODIMENTS

Figure 17:
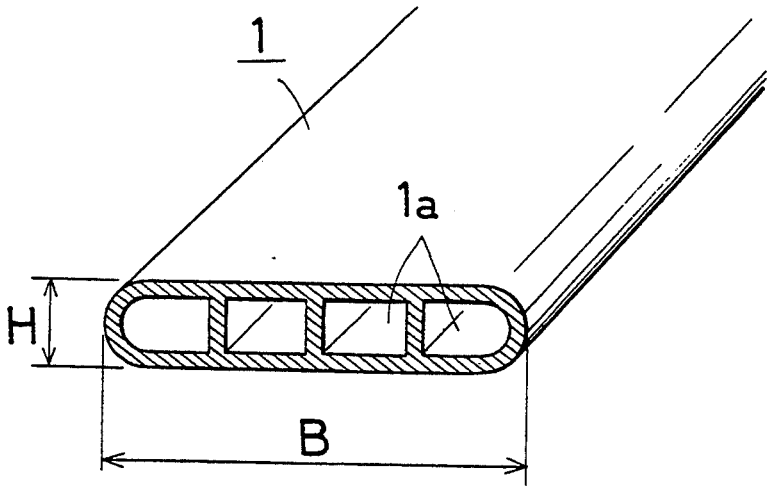
FIG. 17 is a perspective view showing a cross section of a tube for a heat exchanger, the tube being an example of the extruded articles.

Now, an extrusion die in the form of a combination die and a method of producing articles by using the die according to the invention will be described in detail, in which a tube 1 for a heat exchanger as shown in FIG. 17 will be taken as a example of the extruded articles.

The extrusion die may be of any type other than the combination die, and thus applicable also to the solid die for producing unhollow elongate articles.

First Embodiment

Figure 1B:
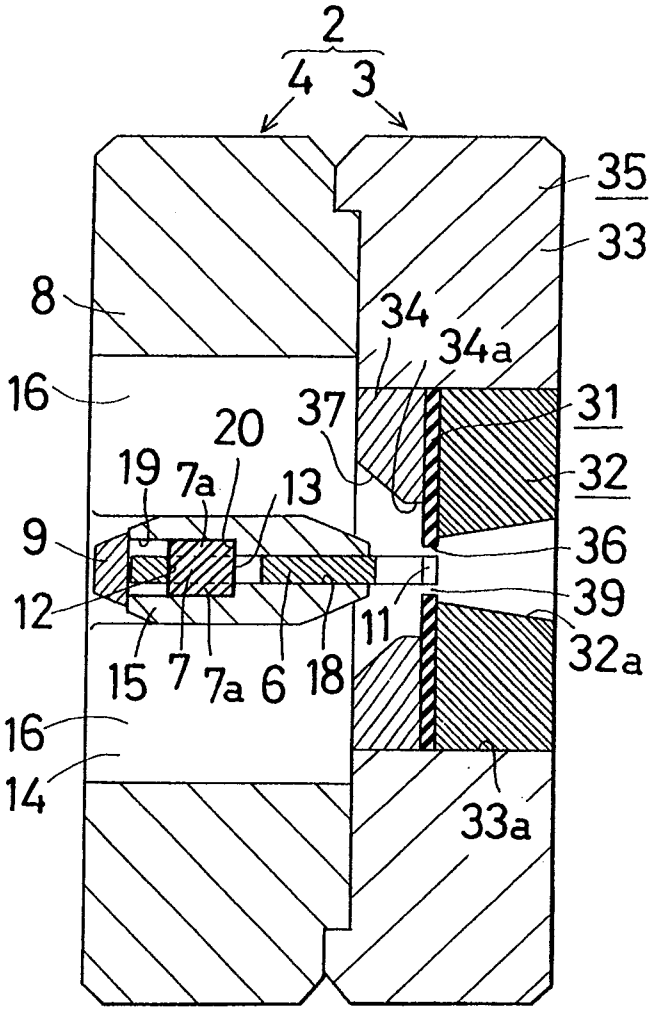
FIG. 1*b* is a cross section taken along the line 1—1 in FIG. 1*a;*
Figure 1A:
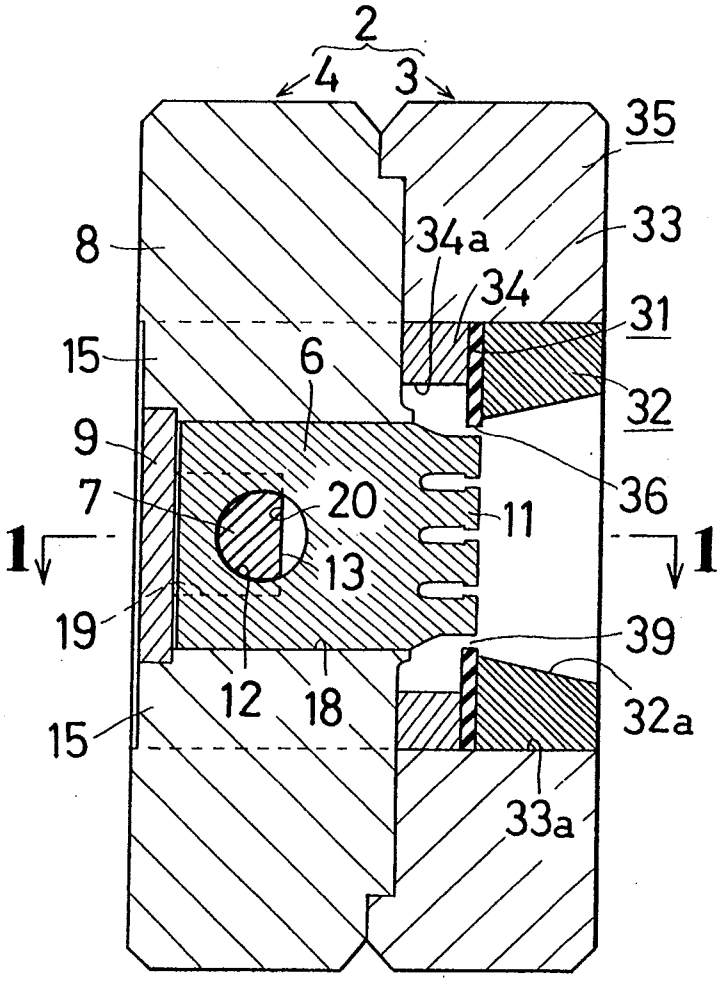
FIG. 1*a* is a horizontal cross-sectional view of a combination die according to a first embodiment.
Figure 2:
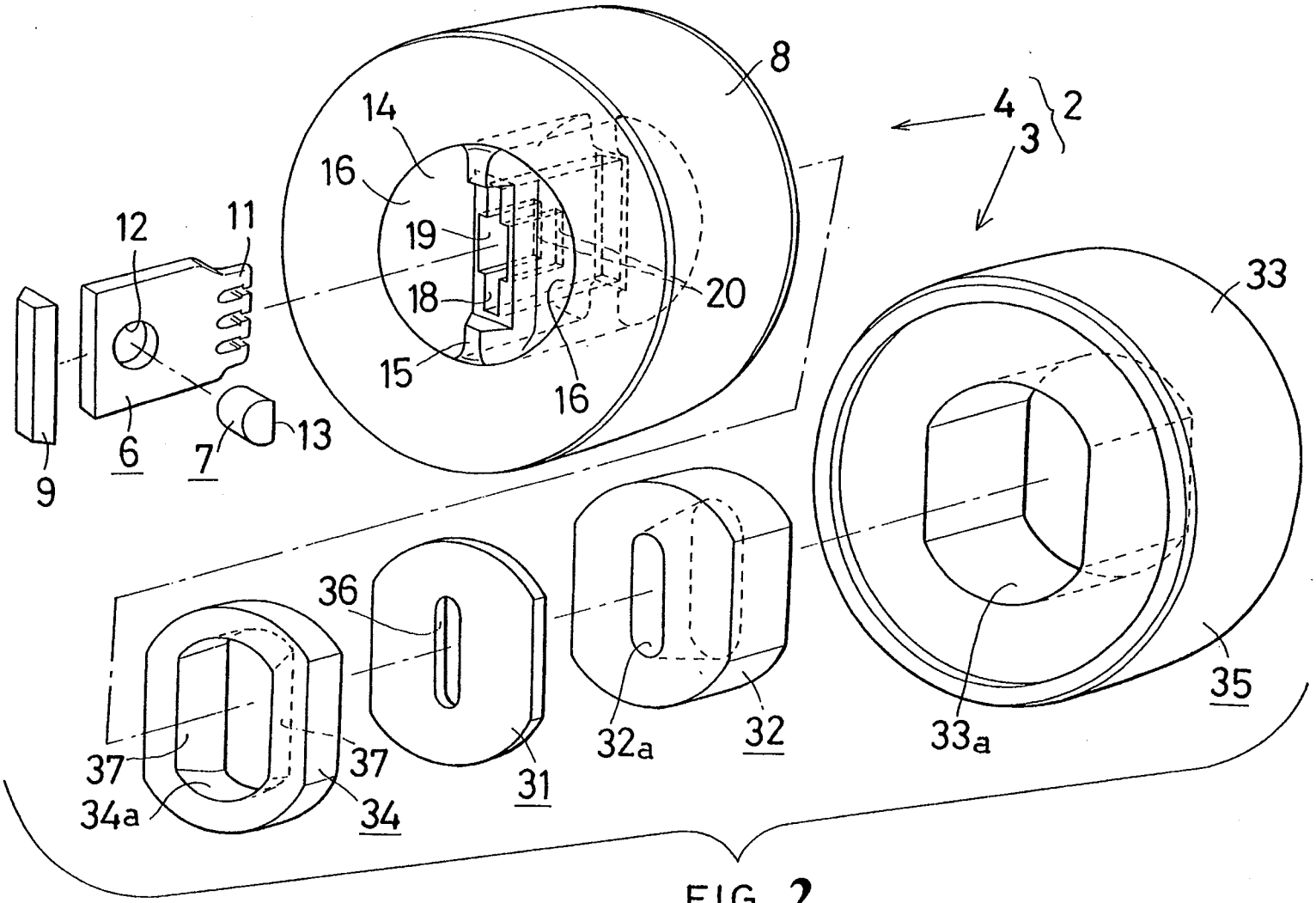
FIG. 2 is a perspective view showing, in a disassembled state, the combination die illustrated in FIGS. 1*a* and 1*b;*

In a combination die 2 shown in FIGS. 1*a* and 1*b*, the reference numeral 3 denotes a female die and the numeral 4 denotes a male die.

The female die 3 comprise a bearing tip 31, a backup block 32, a cylindrical holder 33 and a retaining spacer 34 forming a fusion chamber. The backup block 32, the cylindrical holder 33 and the retaining spacer 34 are members which construct a supporting mold for securing the bearing tip in position.

The bearing tip 31 is made of a thin plate of hard metal and has a central elliptic forming hole 36 having a contour which corresponds to the outer periphery of an extruded article, for example a tube 1. Since an outer periphery of the bearing tip 31 is noncircular, this tip received in a tip receiving bore 33*a* of the cylindrical holder 33 will engage with it not to rotate relative thereto.

The backup block 32 is disposed in front of and in close contact with the bearing tip 31 so as to withstand a strong forward pressure imparted to the tip during the extrusion process. This block 32 which is made of a short columnar piece of a hard metal, similarly to the bearing tip, has an elliptic bell-shaped penetrating hole 32*a*. A rearward opening of the hole 32*a* of the backup block is analogous to, but somewhat larger than, the central forming hole 36 of the bearing tip. Consequently, a continuous edge defining the bell-shaped hole 32*a* extends outside and along a continuous edge which defines the bearing tip's central forming hole 36. Thus, the latter edge of the bearing tip 31 is well protected from being deformed or broken during the extrusion process.

A fusion chamber is formed as a space between the retaining spacer 34 and the male die 4 comprising a bridging member 15. Tributary flows of the extruded material which has been separated one from another by the bridging member will be allied again within the fusion chamber. The spacer 34, which is made of a thick die steel plate, is disposed opposite to the backup block 32 so that the bearing tip 31 is fixedly sandwiched between them. A fusion hole or space 34*a* formed through and axially of the retaining spacer 34 is of such a dimension and shape that the divided tributaries can be fusion-adjoined to be integral with one another. When extruding the multi-bored tube 1 by using this combination die, the extruded material must fill up small spaces between the comb-like projected portions 11 at a forward end of a core 6 secured in the male die 4. Therefore, inner wall surfaces defining the fusion hole 34*a* and facing the projected portions 11 are tapered as indicated by the numeral 37, in such a manner that a distance between said wall surfaces decreases towards bearing tip. An outer periphery of the spacer 34 is of the same shape as the bearing tip 31 and the backup block 32.

The cylindrical holder 33, which is designed to receive and hold therein the bearing tip 31, the backup block 32 and the retaining spacer 34, is made of a die steel and has a tip receiving bore 33*a* extending axially of the holder and penetrating the central portion thereof. An inner periphery of this bore 33*a* is noncircular so that the tip 31, the block 32 and the spacer 34 are fitted therein free from angular relative displacement.

In order to assemble the female die 3, the step of successively inserting the backup block 32, the bearing tip 31 and the retaining spacer 34 in this order into the bore 33*a* of the cylindrical holder 33 will be carried out at first. Next, these members will be subjected to the shrinkage-fit process so that the block 32 and the tip 31 are rigidly combined with the holder 33 to form an integral unit.

On the other hand, the male die 4 which has to mate the female die 3 is composed of the core 6, a stopping pin 7, a mold 8 for holding in place the core, and a rear cover 9.

The core 6 may be produced by manufacturing a flat raw plate of a die steel, a hard metal, a ceramics or the like. The core 6 has at its inner end a plurality of projected portions 11 which are arranged in a comb-like pattern to form hollow spaces 1 a extending longitudinally of the tube 1. The projected portions may be formed by any conventional method such as the electron discharge method (abbr. "EDM"). A circular pierced opening 12 is formed transversely of and at a middle height of the core, through its flat region and near its outer (i.e., rearward) end. This opening may be formed using the so-called "wire cut electric spark machine".

The stopping pin 7 may be made from a columnar raw piece of the same material as the core 6. A flat cut surface 13 extends the full axial length of and axially of the pin in such a state that its outer periphery remaining arcuate does extend beyond its semicircumference in cross section. The pin 7 has a length greater than the thickness of the core 6, whereby both side ends of the pin protrude outwardly of the core when inserted in the pierced opening 12. Diameter of the pin 7 is substantially equal to or slightly smaller than the diameter of the opening 12 formed through the core 6, so that the pin 7 can tightly fit in the opening 12.

The mold 8 for receiving and holding the core is formed with a material flow path 14 which extends centrally and axially of a columnar raw piece from which the mold is manufactured. A bridging member 15 integral with the mold 8 is disposed across the flow path 14 and divides it into two tributaries 16 and 16. A core-holding aperture 18 penetrates the bridging member 15 in the direction of extruded raw material so as to receive and keep the core 6 in accurate place.

Inner wall surfaces of the aperture 18 are shaped such that its contour substantially coincides as a whole with the cross section of the core 6. Thus, the core 6 can almost tightly fit in the core-holding aperture 18.

Guide grooves 19 are formed symmetrically on the facing inner walls at the middle height of the core-holding aperture 18. Those grooves 19 extend a given distance from the outer end towards the inner end of the bridging member, but terminate short of said inner end to thereby provide flat shoulders 20 and 20, respectively. Width, or vertical size, of the grooves 19 corresponds to the diameter of stopping pin 7. Therefore, both the side ends of pin are guided by the grooves 19 when the pin is fitted deep in the aperture 18.

The rear or outer end surface of the bridging member 15 is located inwardly of the outer end surface of the mold 8 so that a space for receiving the rear cover 9 is preserved. The rear cover 9 has a rear side which is convex rearwardly so that the extruded material is divided to flow smooth into the tributaries 16 in the mold 8.

The male die 4 may be assembled by inserting at first the stopping pin 7 in and through the pierced opening 12 of the core 6. The flat cut surface 13 of the pin 7 must be positioned to face the forward portion of the core with respect to the flow direction of extruded material. The core 6 is then pushed forward (i.e., inwardly) to slide into the core-holding aperture 18, until the pin's side ends 7*a* come into contact with and are pressed to the shoulders 20 within the aperture 18. In this way, the core 6 takes its correct position in the fore and aft direction relative to the mold 8, whereby the projected inner end portions 11 of the core 6 are disposed ahead a given distance from the innermost (i.e., foremost) end surface of the mold 8. Subsequently, the rear cover 9 is fitted in the rear space of the mold 8 and welded or otherwise secured thereto.

The male die 4 which is assembled in the described manner will be combined with the female die 3 to provide the combination die assembly. 2. A continuous slit 39 is defined between the inner end portions 11 of the core 6 and an inner periphery of the forming hole 36 in the female die. The configuration of the slit corresponds to the cross-sectional shape of extruded tube 1. Such a combination die assembly 2 will then be mounted on an extruder, and an extrusion material will be forced through and forwardly of the die assembly to continuously form a multi-bored flat tube 1.

The female die 3 in this embodiment is advantageous as will be summarized below. The bearing tip 31 incorporated in this female die can be replaced with a new one, with the other members of the die being reused. Therefore, renewal and maintenance of the die will not raise the running cost, even if abrasion or deformation of the edge around the central hole 36 would occur in the course of a long period of extrusion.

Since the bearing tip 31 is made of the hard metal, it will scarcely be abraded or deformed to cause a frequent renewal. The tubes 1 extruded through this bearing tip will be excellent in their dimensional precision.

The backup block 32, which is also made of the hard metal and disposed behind the bearing tip 31 within the cylindrical holder 33, will not only assist said tip 31 to withstand the high pressure of the extruded material but also be protected from deformation which would cause replacement of said block, thus enhancing the efficiency of extrusion process.

Figure 18:
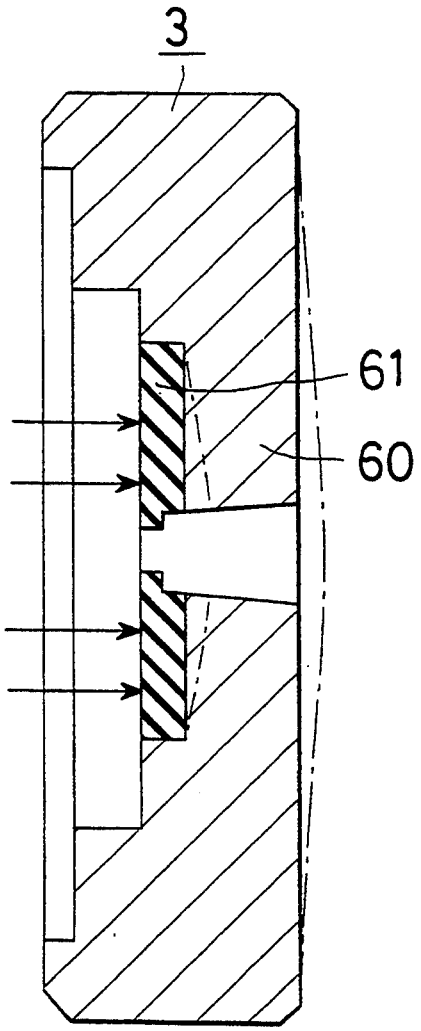
FIG. 18 is a cross section showing the female die in its operating state, the female die being a part of the combination die according to the invention.

FIG. 18 shows a hypothetical case in which the backup block or the supporting mold comprising it and the cylindrical holder are made of an "ordinary" die steel, contrarily to the present invention. The phantom lines in FIG. 18 indicate that a possible deformation of the backup block or its backup portion 60 due to the high extrusion pressure would disable it to stably support the bearing tip 61, thereby causing an undesirable change of said block or portion.

The backup block in the invention economizes the extrusion process, because its material is so hard and strong that the high extrusion pressure does not deform it to be replaced frequently.

Only the bearing tip 31 need be replaced upon abrasion, because it is separable from the backup block 32 made of the expensive hard metal, thus minimizing the maintenance cost for the die assembly.

The tip 31, which is made of the thin plate of a thickness corresponding to the bearing distance through the center hole, can be manufactured easily at a lowered cost.

Since both the outer peripheries of backup block 32 and bearing tip 31 coincide with the inner periphery of tip receiving bore 33*a* of cylindrical holder 33, said block 32 does not need any special means for supporting the tip and thus can be manufactured in a simple manner.

Since the cylindrical holder 33 and members other than the tip 31 and the block 32 are made of the die steel inexpensive and having a higher coefficient of expansion, the total manufacture cost of this female die 3 can be lowered, while enabling the shrinkage fit of the holder onto the tip and block.

The male die 4 in this embodiment is also advantageous in the following points.

Figure 19A:
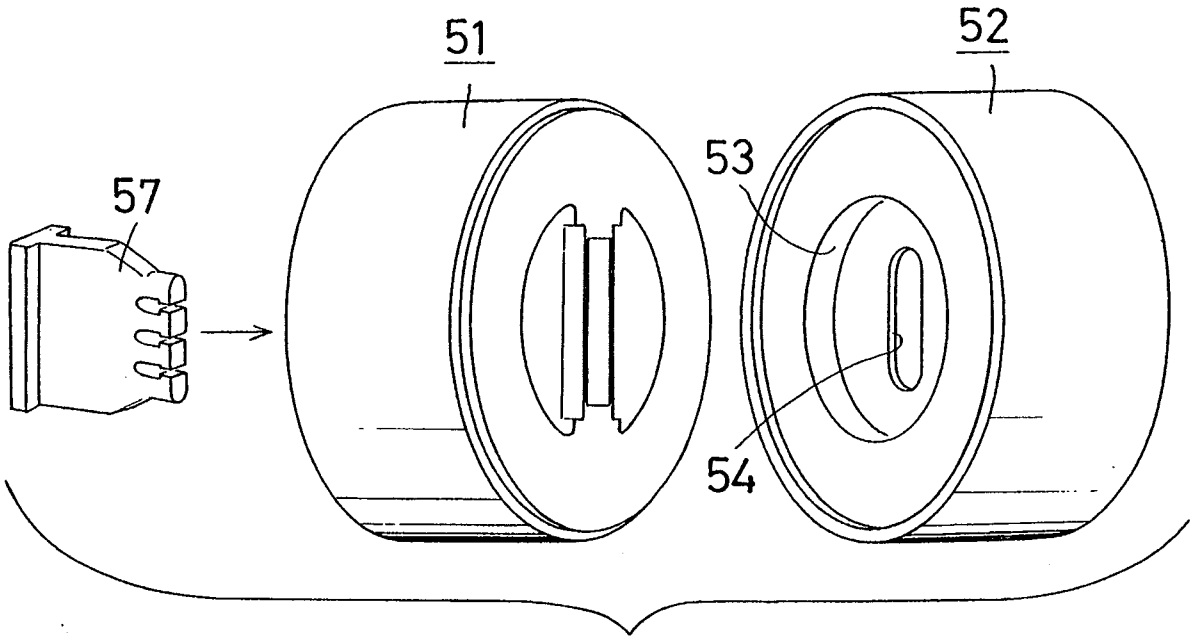
FIG. 19a (PRIOR ART)
FIGS. 19*a* to 19*c* are perspective views showing the prior art combination die.

The core 6 simply has the opening or recess 12 in order to be held by the mold 8, and thus can be produced more easily than that 57 shown in FIG. 19*a* whereby the manufacture cost of die assembly and the running cost of extrusion process are remarkably lowered. Due to such a simple shape, the core 6 can be manufactured advantageously even from a super-hard material such as the hard metal, ceramics or the like.

Figure 19C:
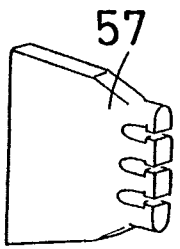
FIG. 19c (PRIOR ART)
Figure 19B:
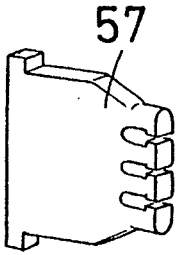
FIG. 19b (PRIOR ART)
Figure 20:
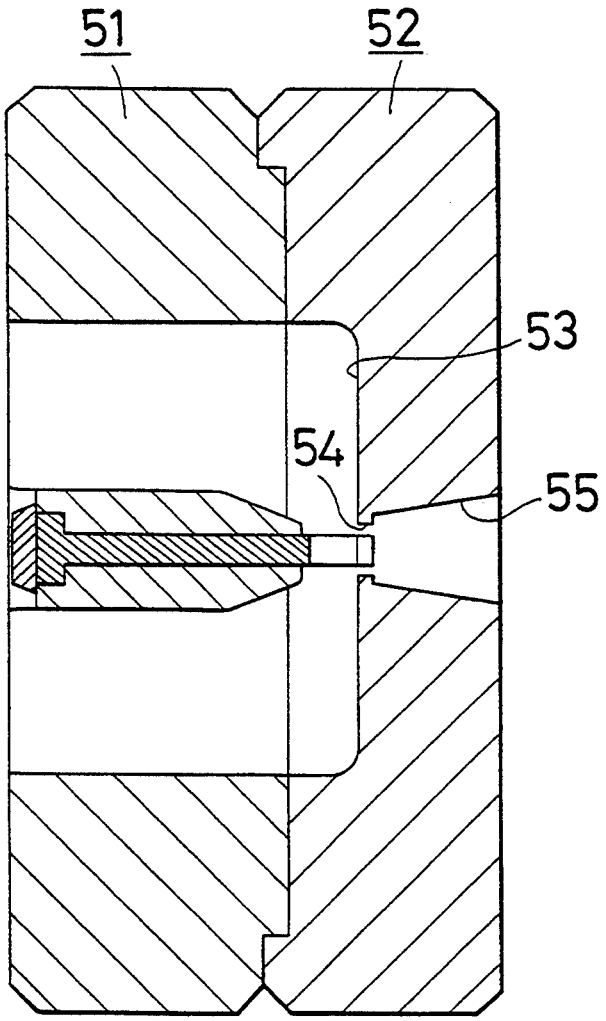
FIG. 20 (PRIOR ART)
FIG. 20 is a cross section of the prior art combination die.

This core 6 supported by the stopping pin 7 is also superior to the core 57 shown in FIG. 19*b* in that it can improve the mechanical strength and durability of the structure, thus diminishing the labor for replacing the worn or broken core with a new one. Since the circular inner periphery of the pierced opening 12 tightly fits on and is supported by the arcuate periphery zone of the columnar pin 7 during the extrusion process, an excessive concentration of stress at the point where the core 6 is supported will be avoided for a higher durability of the combination die assembly 2.

The flat surface portion 13 extend the full length of the pin 7, so that the both side ends of the pin 7 bear against the shoulders 20 in the aperture 18 to thereby render stable the position of said pin.

Further, since the arcuate region of the pin's periphery except for the flat surface portion 13 does extend beyond the semicircumference, the side ends of the pin 7 can be kept in a fitting contact with and be received almost wholly in the guide grooves 19, even if the flat surface portion is not positioned in absolute parallel with the shoulders 20 in the core-holding aperture 18. In other words, the core 6 maintains always and in any case its correct position without any intolerable displacement. By virtue of this feature, the core 6 is protected well from breakage or other damage during the extrusion process.

Additionally, the position of the inner end portion 11 of the core can be adjusted or changed relative to the central hole 36 of the female die, more readily by changing the machined depth of the flat portion 13, than in the core 57 shown in FIG. 19*c*.

Second Embodiment

Figure 3B:
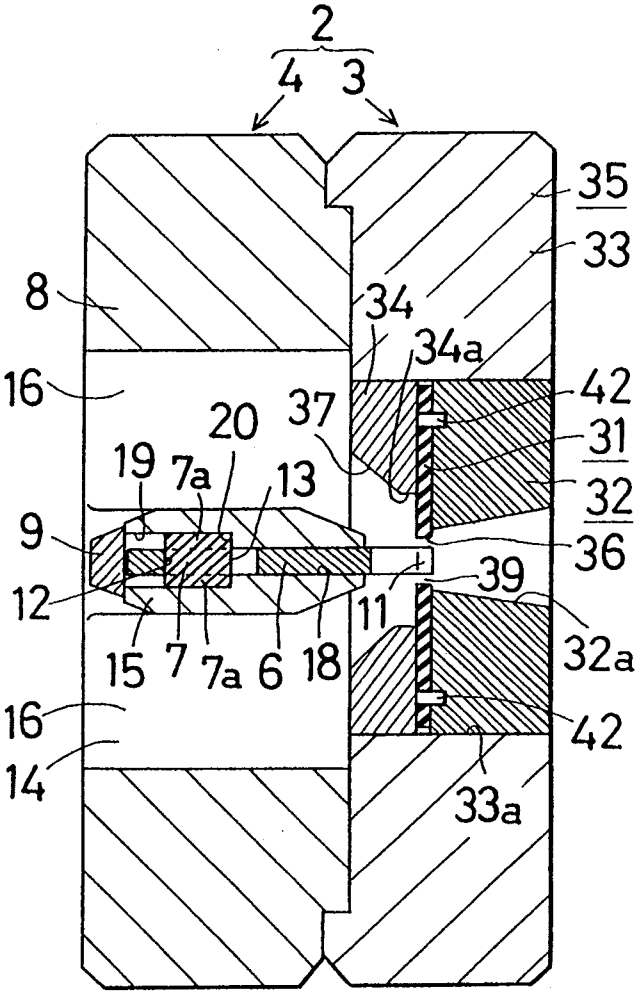
FIG. 3*b* is a cross section taken along the line 3—3 in FIG. 3*a;*
Figure 3A:
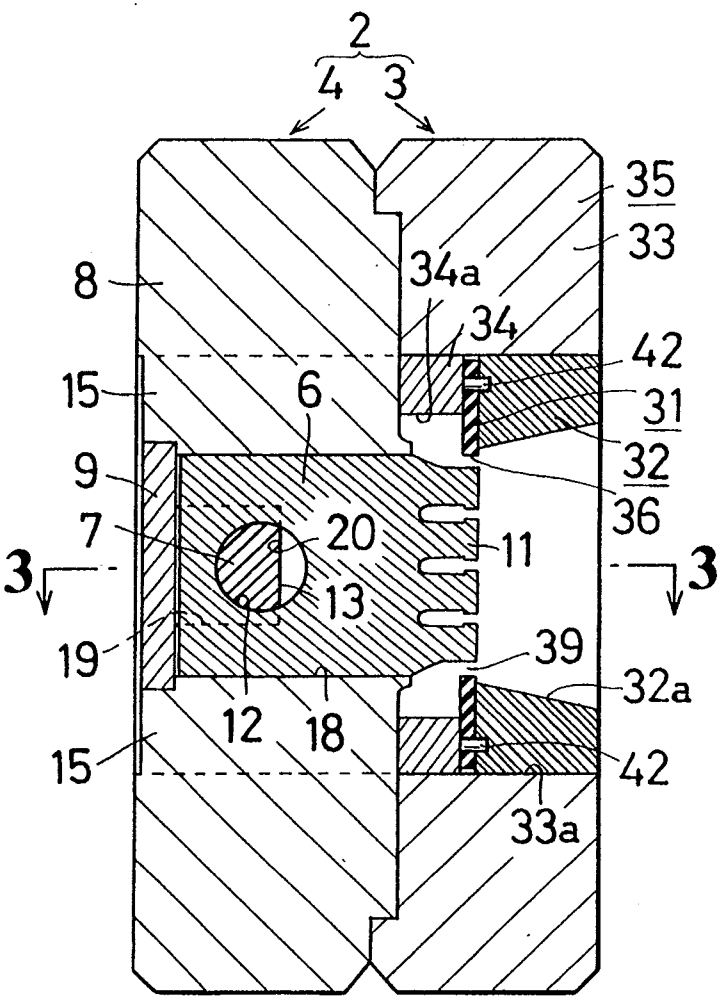
FIG. 3*a* is a horizontal cross-sectional view of a combination die according to a second embodiment.
Figure 4:
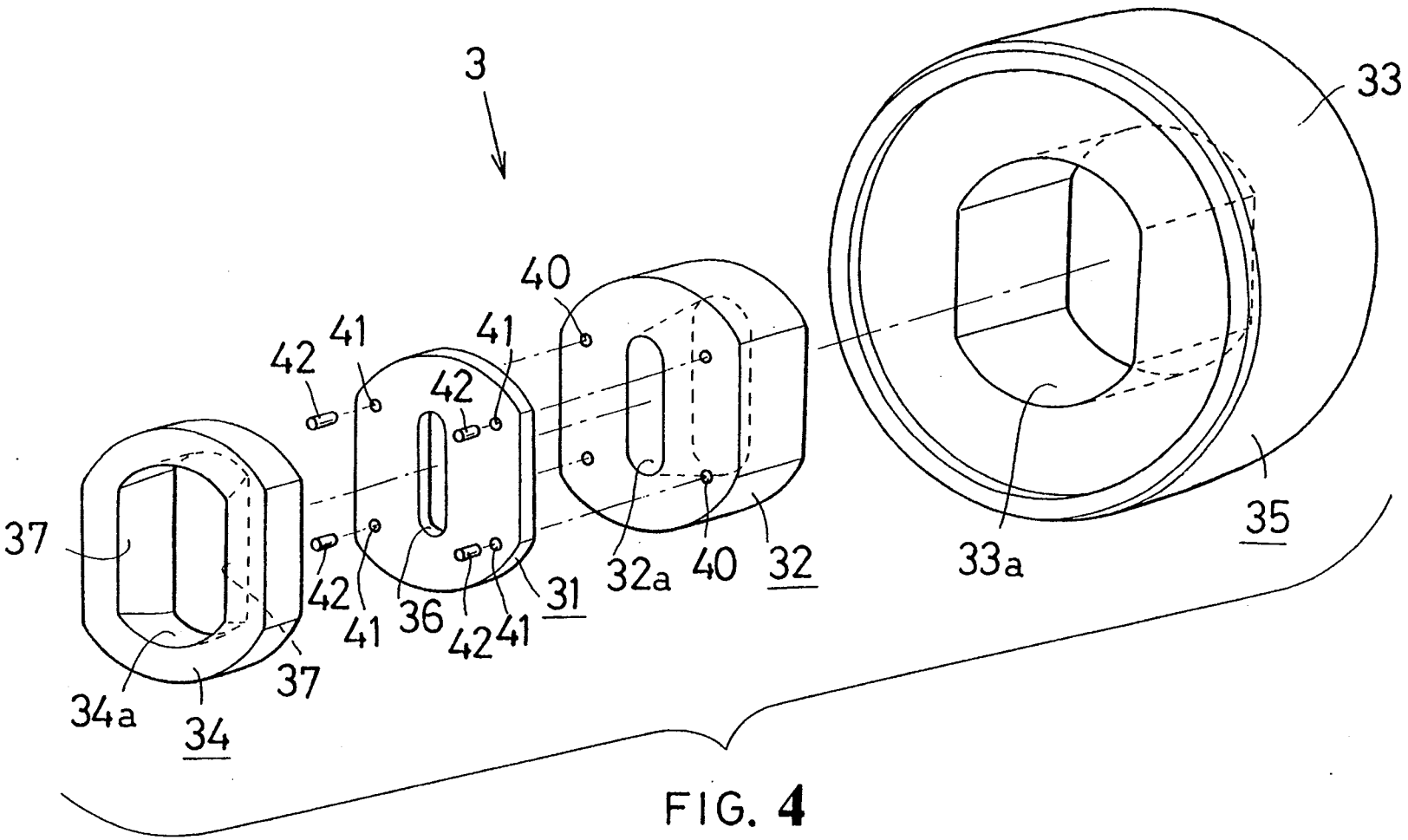
FIG. 4 is a perspective view showing, in a disassembled state, the combination die illustrated in FIGS. 3*a* and 3*b;*

FIGS. 3*a*, 3*b* and 4 show a second embodiment. A female die 3 in the combination die 2 also comprises a bearing tip 31, but its contour is slightly smaller than the tip receiving bore 33*a* of the cylindrical holder 33. Pin holes 40 are formed on the rear end surface of a backup block 32, and corresponding pin holes 41 penetrate the bearing tip 31. Pins 42 are respectively secured in the pin holes 40 and through the corresponding pin holes 41 so that the bearing tip 31 can take its right position relative to the backup block. Other details of structure are the same as the female die in the first embodiment.

The replacing of an abraded bearing tip 31 with a new is easy in this case, because the tip and the spacer 34 can be separated readily from the female die 3, with its backup block 32 remaining shrinkage-fitted in the cylindrical holder 33.

Third Embodiment

Figure 5B:
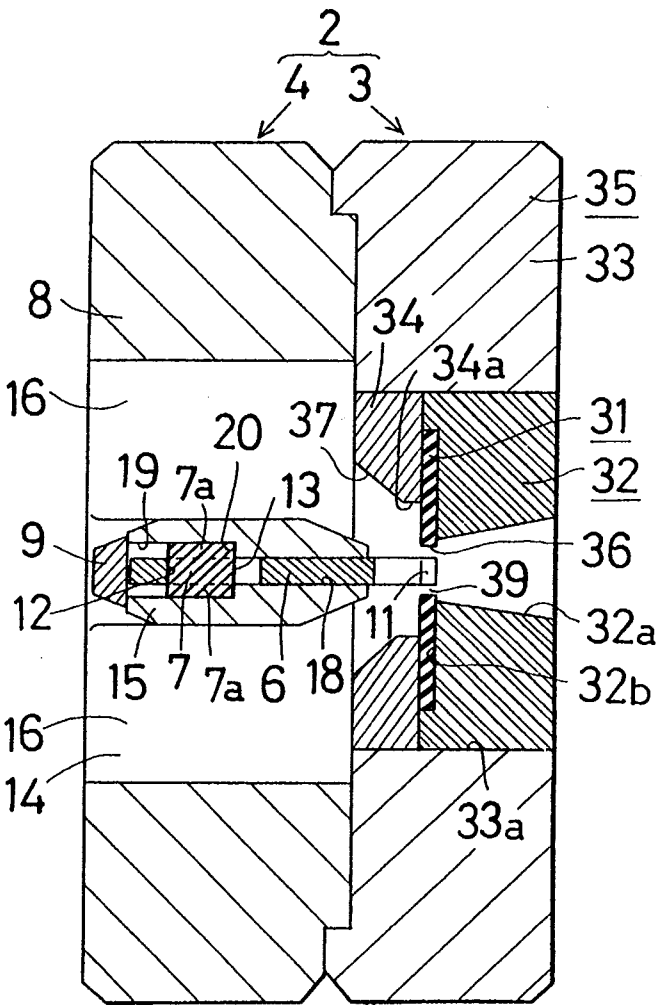
FIG. 5*b* is a cross section taken along the line 5—5 in FIG. 5*a;*
Figure 5A:
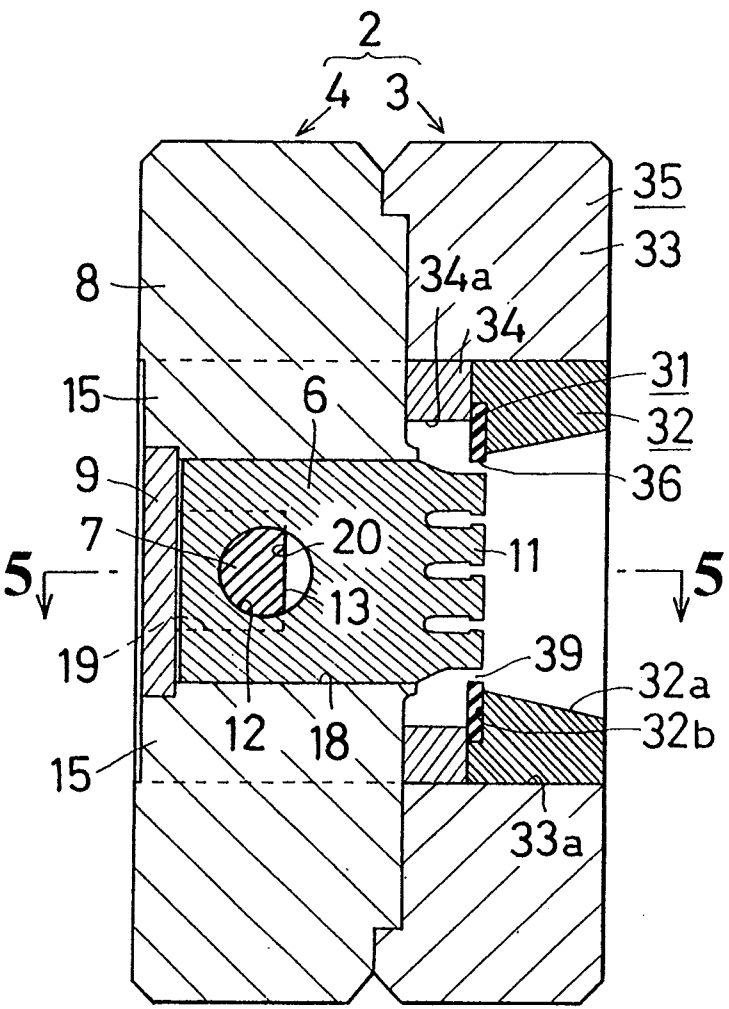
FIG. 5*a* is a horizontal cross-sectional view of a combination die according to a third embodiment.
Figure 6:
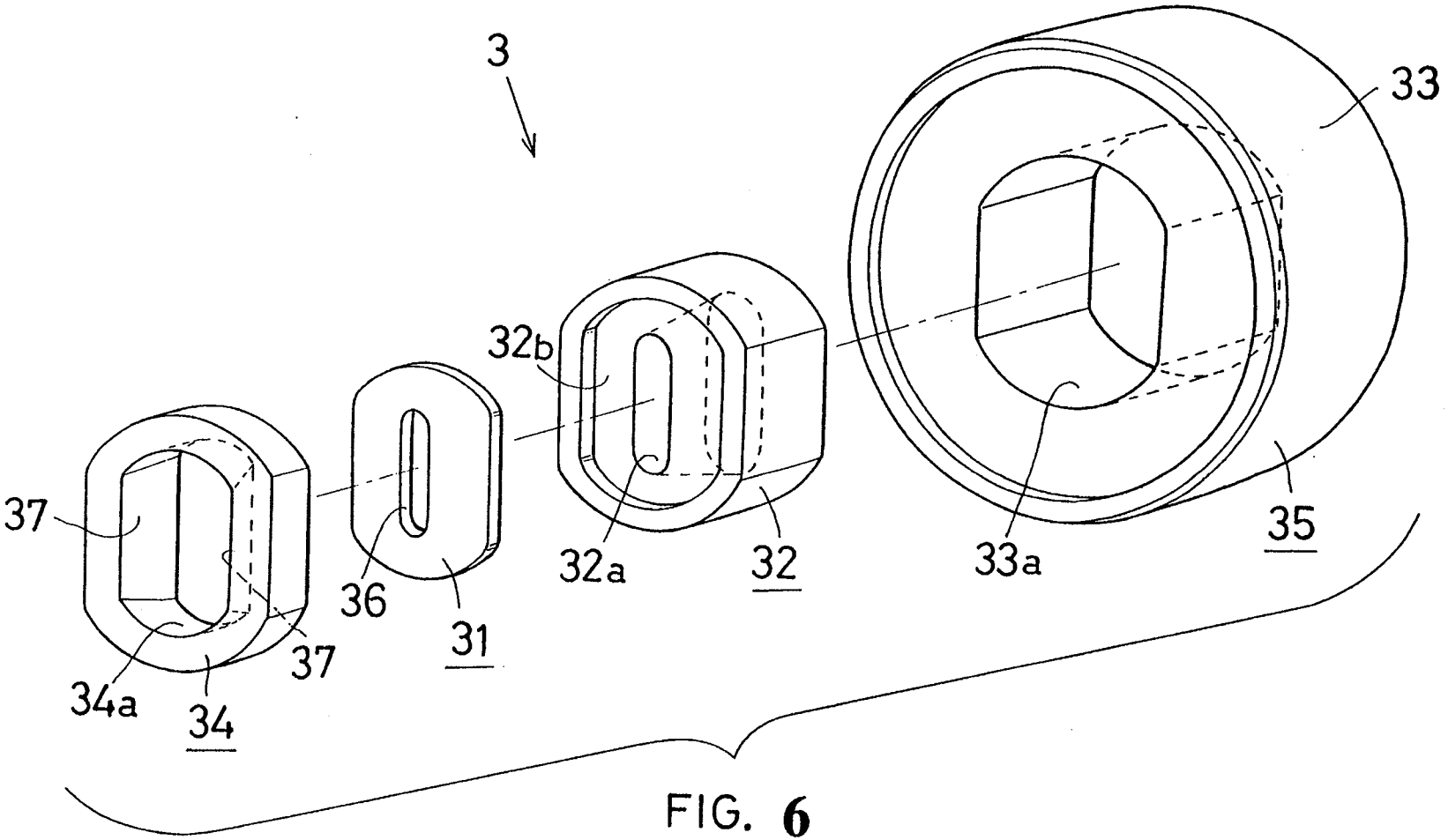
FIG. 6 is a perspective view showing, in a disassembled state, the combination die illustrated in FIGS. 5*a* and 5*b;*

FIGS. 5*a*, 5*b* and 6 show a third embodiment, in which the female die 3 comprises a backup block 32 having a shallow recess 32*b*. This recess formed on the rear end surface of said block has a contour and depth corresponding to the bearing tip 31, which fits in the recess. Other features are the same as the first embodiment.

In this case, the bearing tip 31 is neither shrinkage-fitted in the cylindrical holder 33 nor integrally adjoined to the backup block 32. The tip 31 which is made of the same material as the block 32 is not shrinkage-fitted thereon. Since only the abraded bearing tip need be removed to be replaced with a new one, the reassembling operation is so easy as in the case shown in FIGS. 3*a* to 4. In addition, the bearing tip 31 is so thin that the recess 32*b* for receiving it can be machined without any difficulty.

Fourth Embodiment

Figure 7B:
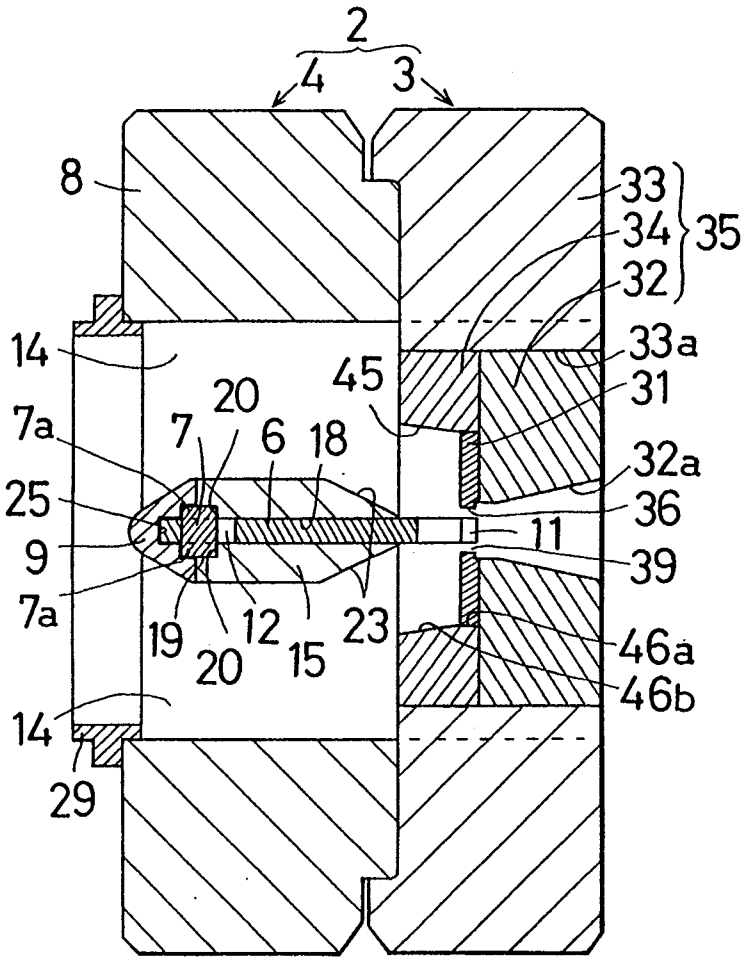
FIG. 7*b* is a cross section taken along the line 7—7 in FIG. 7*a;*
Figure 7A:
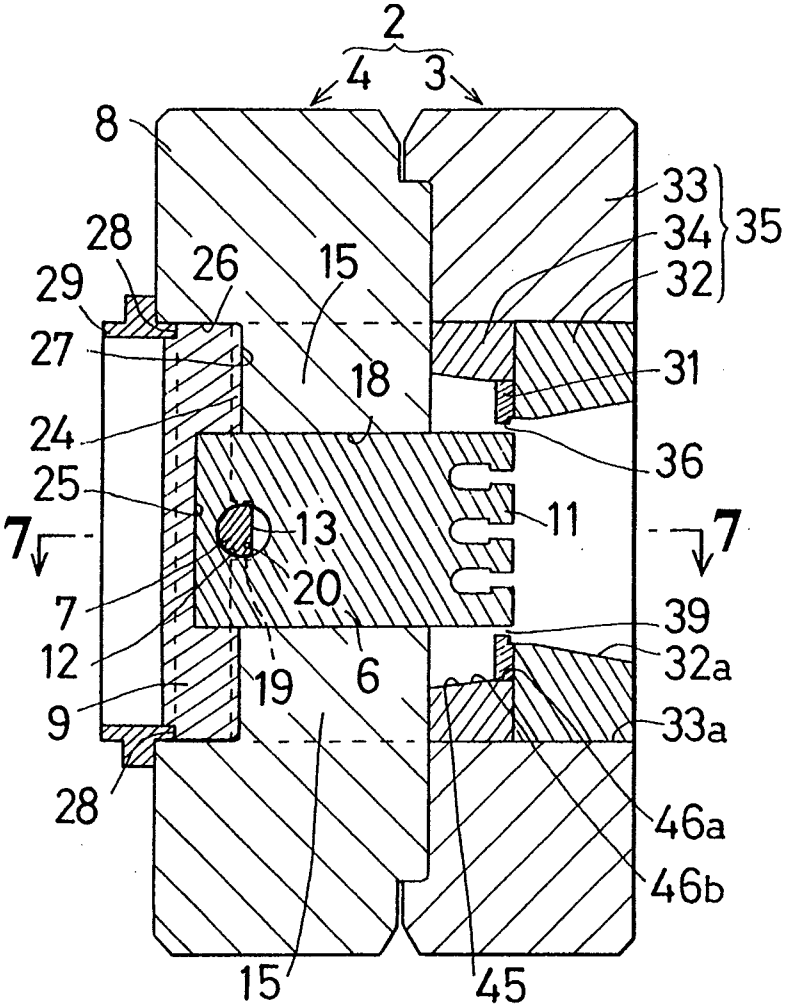
FIG. 7*a* is a horizontal cross-sectional view of a combination die according to a fourth embodiment.
Figure 8:
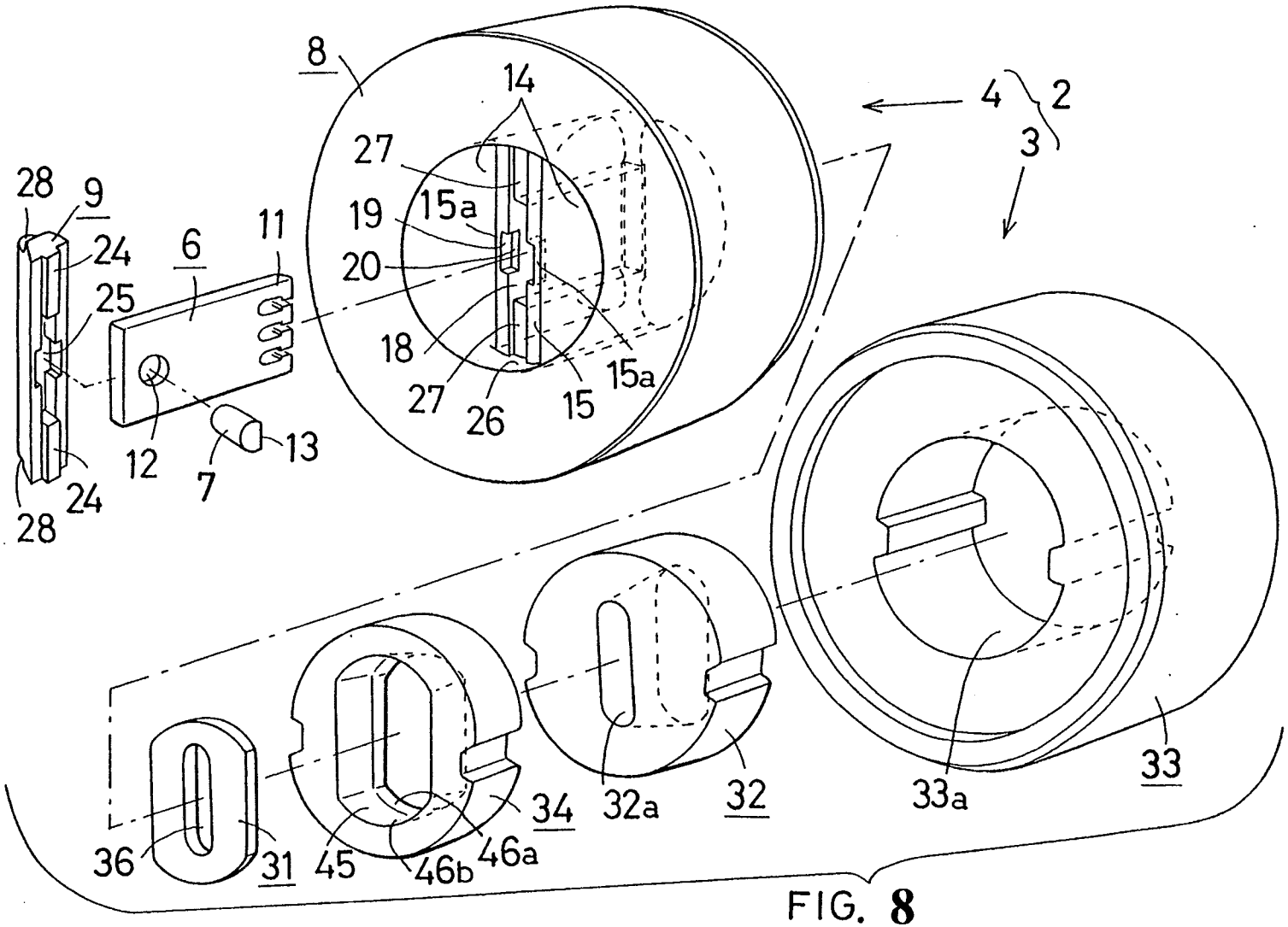
FIG. 8 is a perspective view showing, in a disassembled state, the combination die illustrated in FIGS. 7*a* and 7*b;*

In this case shown in FIGS. 7*a* to 8, the female die in the die assembly 2 is composed of a supporting mold 35 and a separable bearing tip 31. This supporting mold comprises a backup block 32, a fusion chamber spacer 34 and a cylindrical holder 33, wherein the spacer 34 functions as a metal flow regulator.

Figure 9:
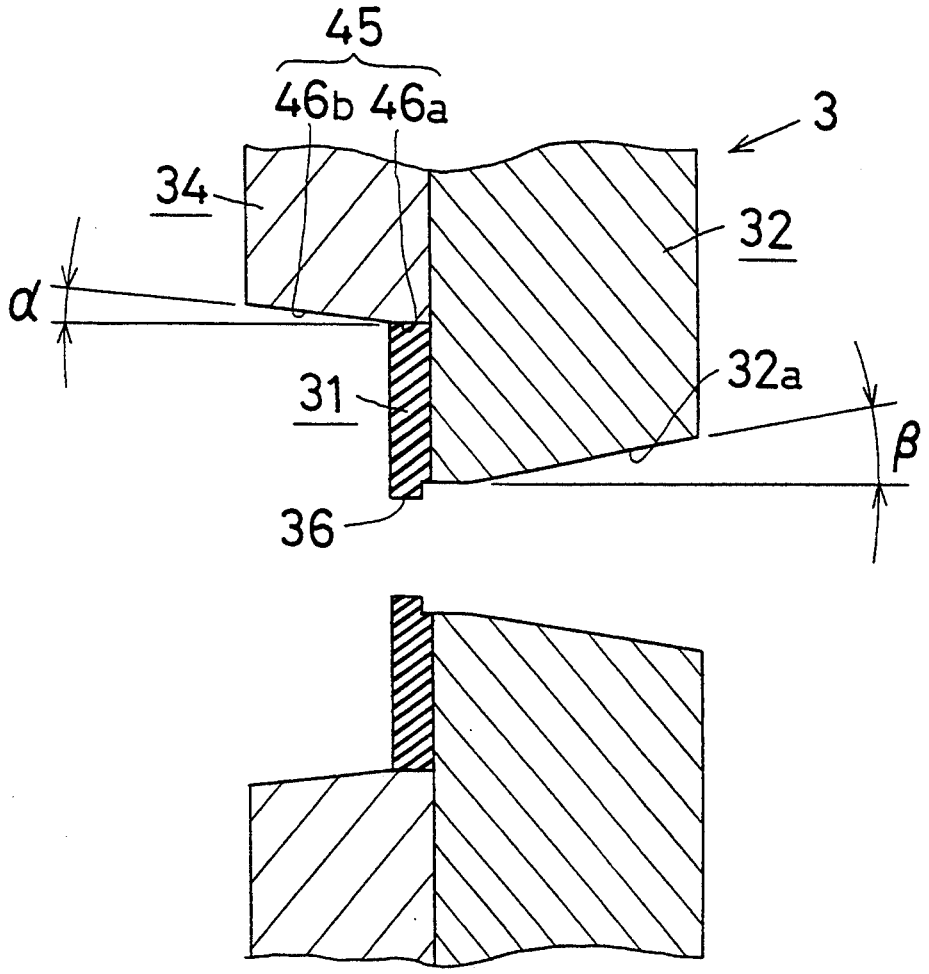
FIG. 9 is an enlarged cross-sectional view showing a central forming hole of the female die in FIGS. 7*a* and 7*b;*
Figure 10:
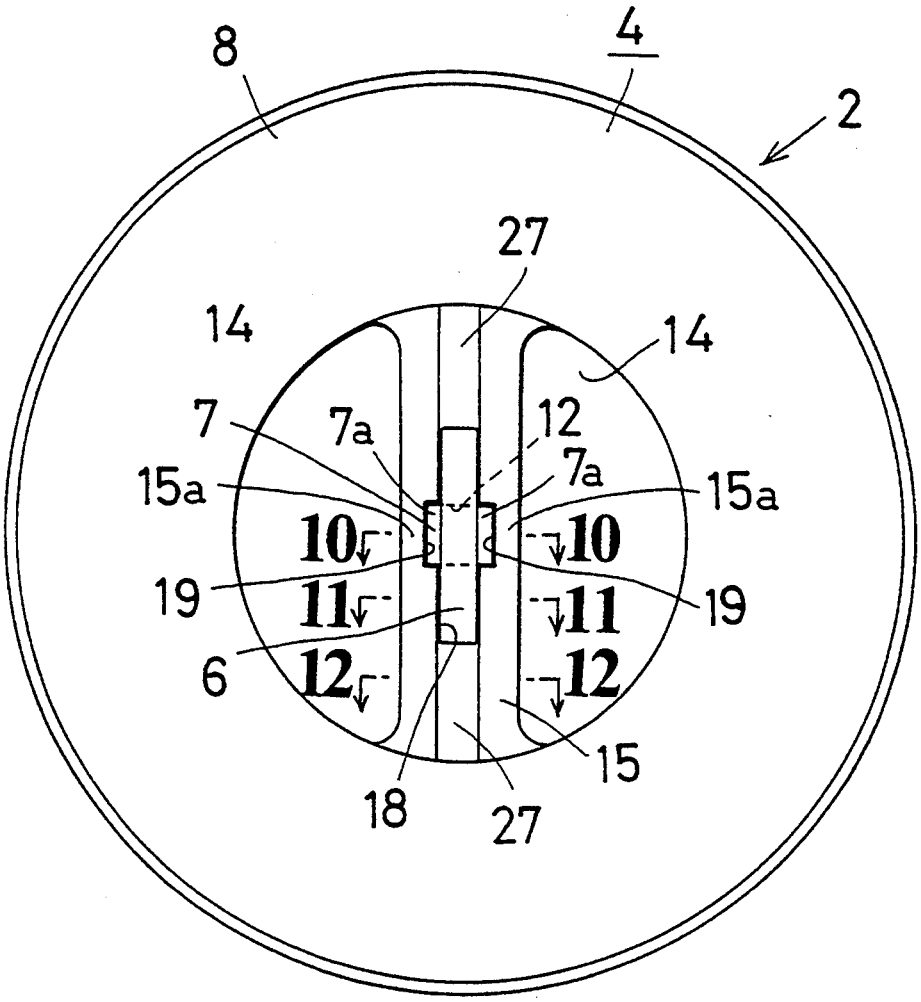
FIG. 10 is a rear elevational view of the die in FIGS. 7*a* and 7*b*, but with its rear cover removed.

The bearing tip 31 made of a hard metal thin plate is formed with a central elliptic hole 36 of a contour defining the outer periphery of extruded articles such as the tube 1. Although the thickness of the tip 31 is usually equal to the "bearing length", said tip may be thicker than said length as shown in FIG. 9. In such a modification, a fine stepped annular portion is formed around the central forming hole 36. The contour of this bearing tip 31 is noncircular and fittable in a forward end of metal flow hole 45 of the abovementioned spacer 34.

The backup block 32 is disposed in front of the bearing tip 31 so as to bear a high pressure loaded thereto during the extrusion process. Extending through the backup block 32, which is a short columnar body made of the same hard metal as the bearing tip, is an elliptic and bell-shaped hole 32*a* whose opening adjacent to said tip 31 is analogous to larger than the forming hole 36 thereof. In the assembled female die, an edge around the bell-shaped hole 32*a* is close to an edge of the forming hole 36, whereby the former reinforces and protects the latter from any deformation or breakage during the extrusion. The angle $\beta$ between the tapered wall of said hole 32*a* and an normal line perpendicular to the bearing tip is about 10°.

Provided between the spacer 34 and the male die 4 is a fusion chamber in which the tributary flows of an extruded material, which has been divided by the bridging member of the male die, are adjoined one to another. The spacer 34 disposed in rear of the backup block 32 is made of a a hard metal thick plate, and has the same contour as said block. A material flow hole 45 formed axially of the spacer 34 is of such a length and diameter that the tributaries of the extruded material can be rigidly consolidated with one another.

The flow hole 45 functions also as a hole to receive the bearing tip. As shown in FIG. 9, a forward end region of said hole 45 is a bearing tip-fixing portion 46*a*, while a rearward main region is a bearing tip-guiding portion 46*b*.

The inner periphery of the tip-fixing portion 46*a* accurately coincides with the outer periphery of the bearing tip 31. The depth of said portion 46*a* is equal to the thickness of said tip 31. The angle $\alpha$ between the wall of the tip-guiding portion 46*b* and the axis of this die is about 5°. Thus, a distance between opposite wall surfaces of this spacer increases towards the rear end thereof in such a manner that those portions 46*a* and 46*b* generate a continuous line and the bearing tip can smoothly be guided into this die.

The cylindrical holder 33 made of a die steel has an axially extending hole 33*a* for receiving the backup block 32 and the spacer 34 forming the fusion chamber. The contour of the hole 33*a* in cross section is noncircular such that the bearing tip 31, the block 32 and the spacer 34 are received and fixed therein not to rotate relative to said holder.

This female die 3 will be assembled in the following manner. At first, the backup block 32 and the spacer 34 are inserted in this order into the hole 33*a* from its rearward opening before they are shrinkage-fitted to and become integral with the cylindrical holder 33. The bearing tip 31 will then be inserted into the material-flowing hole 45 through its guiding portion 46*b* until tightly received in its fixing portion 46*a*. The front surface of the bearing tip 31 in this state is in close contact with the rear end surface of the backup block 32.

On the other hand, the male die 4 in this embodiment is shown in FIGS. 7*a* to 8 and 10 to 12*c*. The mold 8 in this case has a core-receiving aperture 18 formed with shallower guide grooves 19. Those bottoms have shoulders 20 on which the flat surface portion 13 of the stopping pin 7 rests in such a state that the rearward arcuate portion of said pin protrudes rearwardly from the entrance of said aperture 18.

Alternatively, the depth of those shoulders 20 may be such that the pin 7 has its rearward portion not protruding from but wholly received in the aperture 18 and located close to its rearward entrance.

As shown in FIG. 8, this mold 8 has a bridging member 15 integral therewith and formed with its rear end surface located forwardly of the rear end of said mold so that a space 26 for receiving a rear cover 9 is provided. Shallow recesses 27 are formed on the rear end surface of the bridging member 15 and extending radially of this mold from the center aperture 18.

FIG. 7*b* shows pressure-bearing areas 23 formed as the oblique forward zones of the surface of bridging member whose thickness is reduced towards its front end. Those areas 23 subjected to the backward pressure of the extruded material are preferably made broad enough for the bridging member 15 to strongly grip the core 6 during the extrusion process. This feature is advantageous in that the stress imparted to the stopping pin 7 is diminished to thereby decrease its diameter and the width of the guide grooves 19.

The rear cover 9, which is of such a shape and dimension as fitting in the space 26 at the rear end of the mold's bridging member 15, is also convex rearwardly so that the extruded material can be divided smooth into the tributaries 16 formed through the mold 8.

FIG. 8 shows the front configuration of the rear cover 9, wherein a central recess 25 is designed to receive both the rearwardly jutting ends of the core 6 and pin 7, and side lugs 24 are formed beside the central recess so as to fit in the aforedescribed shallow recesses 27 of the bridging member 15. A ring 29 shown in FIGS. 7*a* and 7*b* is fitted in side rearward cutouts 28 of the cover 9.

The male die 4 may be assembled, in a manner similar to that in the first embodiment, by inserting at first the stopping pin 7 in and through the pierced opening 12 of the core 6. This core 6 is then pushed forward (i.e., inwardly) to slide into the core-holding aperture 18, until the flat cut surface 13 at the pin's side ends 7*a* come into contact with and are pressed to the shoulders 20 within the aperture 18.

Figure 11:
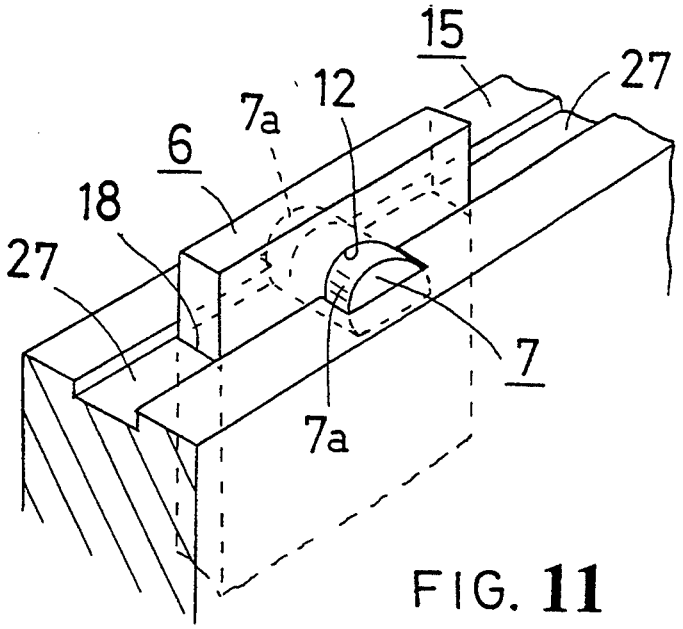
FIG. 11 is a perspective view of a core supported within the die shown in FIGS. 7*a* and 7*b;*
Figure 12A:
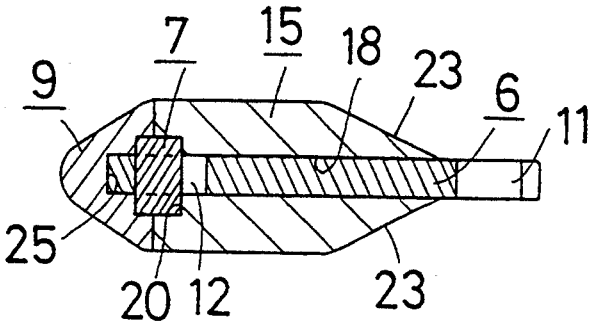
FIG. 12*a* is a cross section taken along the line 10—10 in FIG. 10.
Figure 12B:
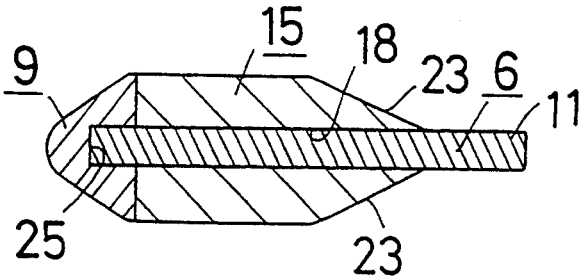
FIG. 12*b* is a cross section taken along the line 11—11 in FIG. 10.
Figure 12C:
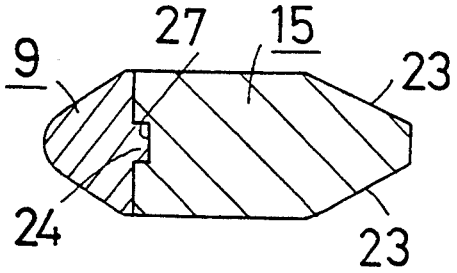
FIG. 12*c* is a cross section taken along the line 12—12 in FIG. 10.

With the core 6 inserted in this way, the rear portion of the pin 7 juts outwardly of the bridging member's aperture 18 as illustrated in FIG. 11. The rear portion of the core 6 itself also juts backwards with respect to the rear end of the aperture 18.

Then, the rear cover 9 is put in the space 26 formed rearwardly of the bridging member 15 so that the central recess 25 receives the rearward end portions of the core 6 and pin 7. At the same time, the shallow recesses 27 tightly receive therein the side lugs 24 in a state shown in FIGS. 12*a* to 12*c*, whereby the male die 4 is provided in its assembled state.

The male die 4 which is assembled in the described manner will be combined with the female die 3 to provide the combination die assembly 2. A continuous slit 39 is defined between the inner end portions 11 of the core 6 and an inner periphery of the female die's forming hole 36. The configuration of the slit corresponds to the cross-sectional shape of extruded tube 1. A ring 29 will be attached to the rear end of the die assembly 2. Then, an amount of molten aluminum or the like metallic material to be extruded will be poured into the die assembly before it is mounted on an extruder. Subsequently, the raw material in its solid state will be forced through and forwardly of the die assembly to continuously form a multi-bored flat tube 1.

The female die 3 in this embodiment affords the following advantages.

When the bearing portion of the thin tip 31 has been abraded to be replaced with a new one, the abraded tip can be moved rearwards a small distance into the guiding portion 46*b*. Since this portion 46*b* is enlarged towards its rear end, the bearing tip 31 can be released easily from the female die. When attaching the new bearing tip, it need be put in the guiding portion 46*b* having its inner diameter reduced towards its foremost end. By further pushing the tip forwards, it will be guide along the inner wall so as to readily enter and be set in place in the fixing portion 46*a* which generates a continuous line together with the guiding portion 46*b*. The operation to attach and detach the thin bearing tip 31 can be done without any difficulty or problem.

Further, since the material flow hole 45 through the spacer 34 for the fusion chamber is defined by the wall of said guiding and fixing portions 46*b* and 46*a*, it is not necessary to remove said spacer when changing the bearing tip 31, thus improving the efficiency of that operation.

The backup block 32 made of the hard metal and supporting the high pressure onto the bearing tip 31 is never deformed thereby during the extrusion process, thus enabling the process to be efficiently continued without the necessity of changing the block.

The tip 31, which is made of the thin plate of a thickness corresponding to the bearing distance through the center forming hole, can be manufactured easily at a lowered material cost.

Since the cylindrical holder 33 is not made of the hard metal but of the usual die steel inexpensive and having a higher coefficient of expansion, this female die 3 as a whole can be manufactured at a lowered cost, while enabling the shrinkage fit of the holder onto the tip and block made of the hard metal which has a lower coefficient of expansion.

Because both the bearing tip 31 and the spacer 34 are made of the same hard metal, there is no fear that the strong gripping force of the shrinkage-fitted cylindrical holder 33 would cause any strain of said bearing tip 31 or any displacement thereof resulting from its strain.

The male die 4 also affords the following advantages, in addition to those provided in the first embodiment.

Firstly, the thin walls 15*a* surrounding the aperture 18 of the bridging member 15 in the male die 4 are protected well from undesirable deformation which would occur inwardly due to the pressure of extruded material, because the pin 7 supporting the core 6 within said aperture 18 has its rearward portion jutting rearwardly thereof as shown in FIG. 11, and thus its both side ends do support the thin walls 15*a*. The core 6 which will be worn at its inner end portions 11 in the course of use can now be replaced with a new one, without encountering any difficulty caused by the interference of the pin 7 with the walls 15*a*.

Secondly, since the shallow recesses 27 formed on the rear surface of the bridging member 15 tightly receive therein the side lugs 24 of rear cover 9, this cover which is fixedly secured in place to the member's 15 rear end can be removed therefrom more easily than in the case of welded conjunction when the core 6 is to be replaced.

Thirdly, the cover 9 is free from any transversal deformation at its middle portion, displacement as a whole or droppage during the extrusion process even if any uneven stress or pressure is charged to the cover, because the front lugs 24 and rear recesses 27 extend almost the full length of the member 15 and the cover 9, respectively.

Fourthly, although the pin 7 is positioned so shallow that the rear end of the core 6 protrudes outwardly of the aperture 18 of the bridging member 15, this core is protected from any damage or breakage which might be caused by the sideways deformation and interference of the cover 9 with the core 6. Such a sideways deformation of the cover is inhibited herein by the tight fitting of the lugs in the recesses just mentioned above.

Fifth Embodiment

Figure 13B:
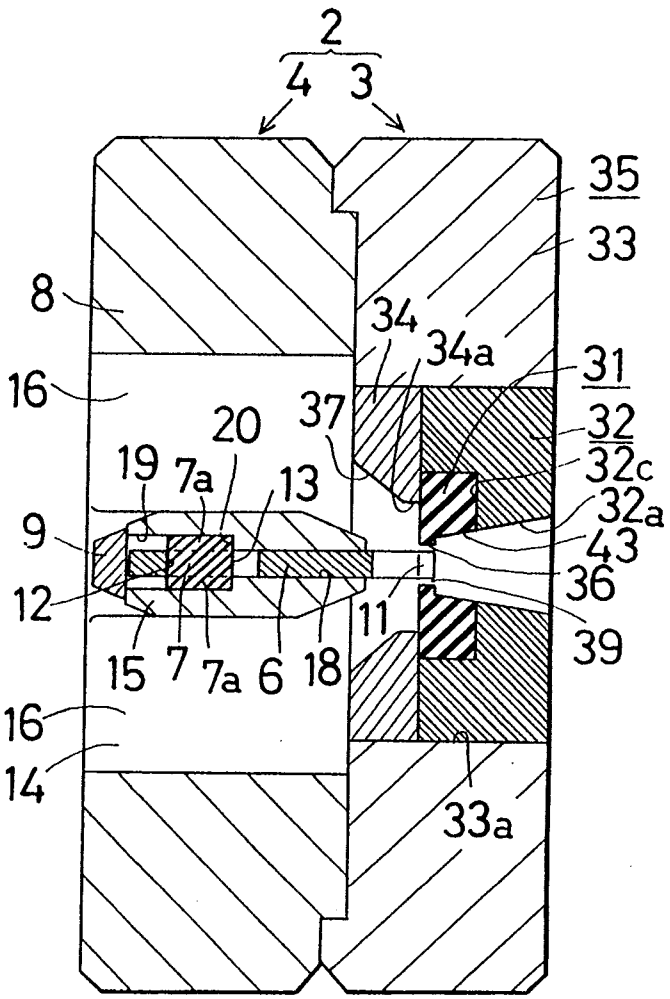
FIG. 13*b* is a cross section taken along the line 13—13 in FIG. 13*a;*
Figure 13A:
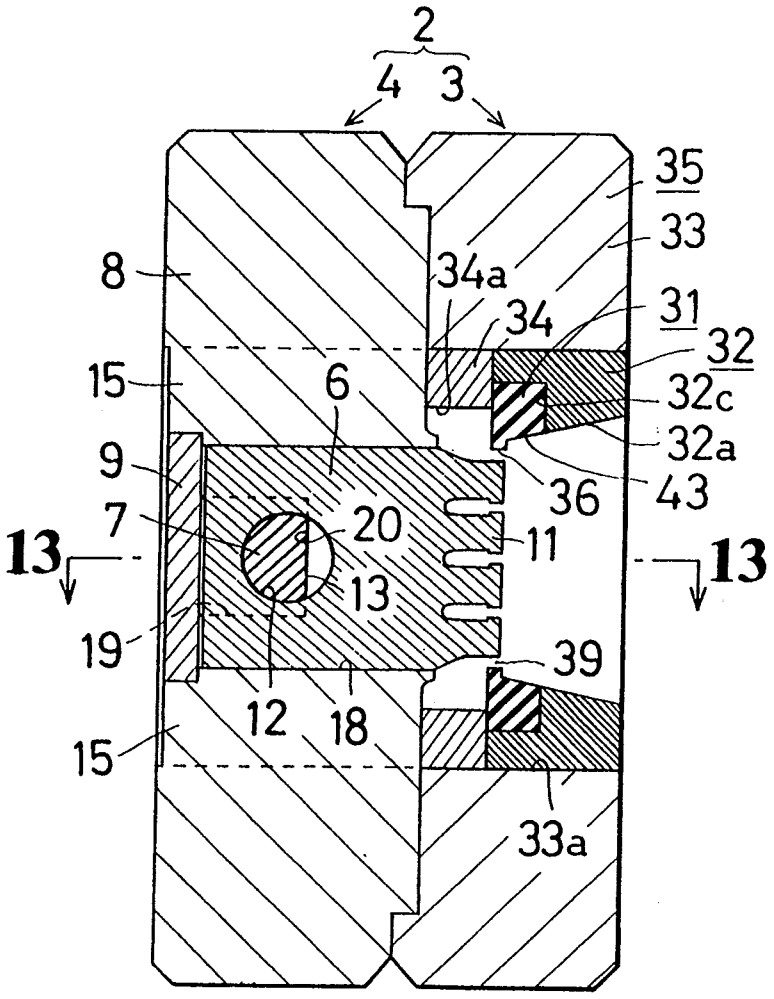
FIG. 13*a* is a horizontal cross-sectional view of a combination die according to a fifth embodiment.
Figure 14:
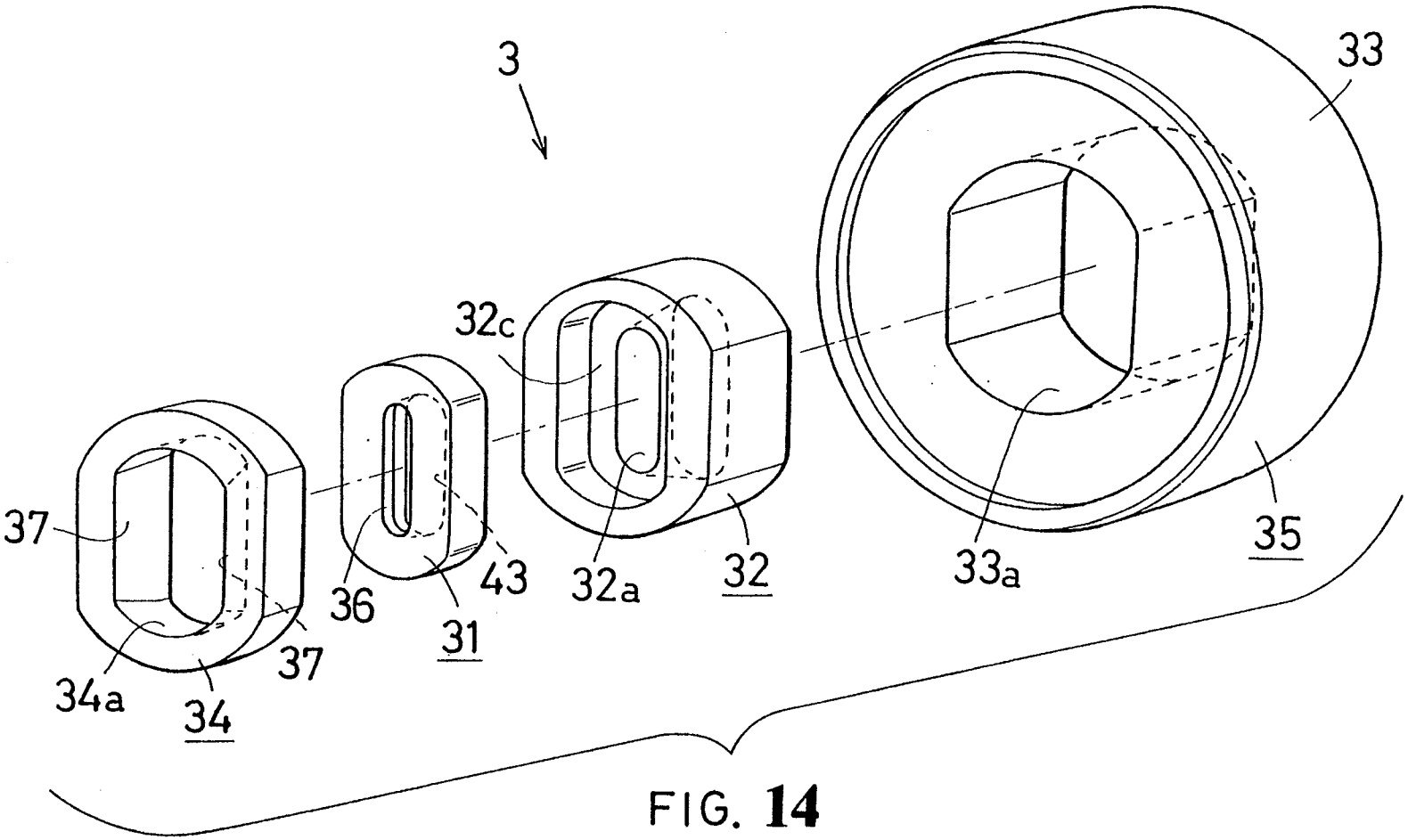
FIG. 14 is a perspective view showing, in a disassembled state, the combination die illustrated in FIGS. 13*a* and 13*b;*
Figure 15A:
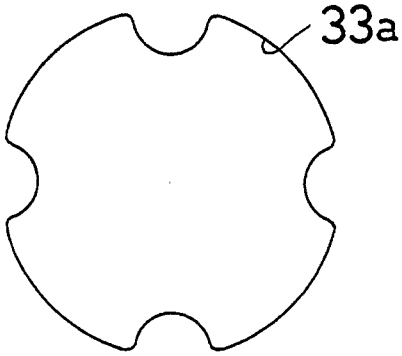
FIGS. 15*a* to 15*f* are contours showing a variety of tip-insertion holes formed through any of the cylindrical holders which are incorporated to the preceding embodiments.
Figure 15B:
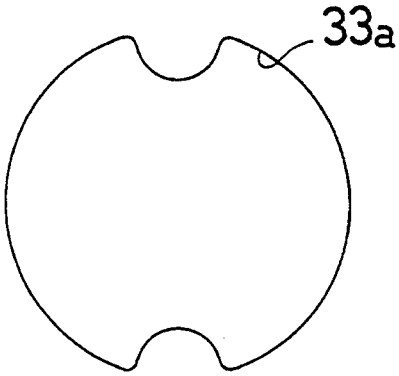
Figure 15C:
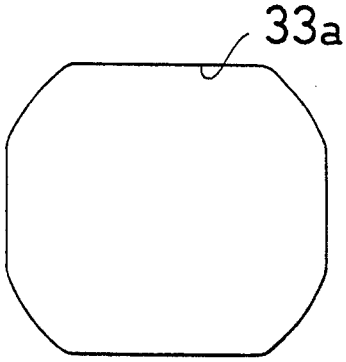
Figure 15D:
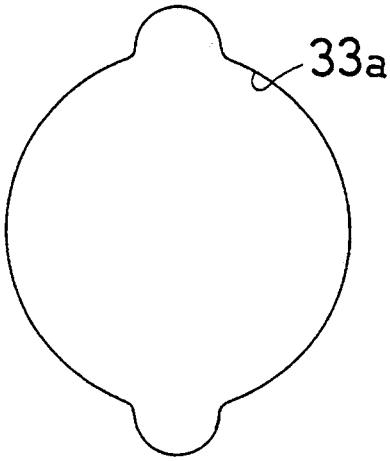
Figure 15E:
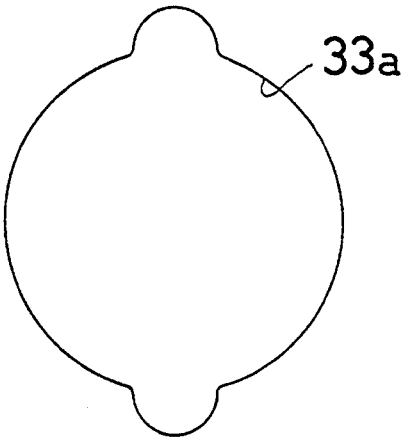
Figure 15F:
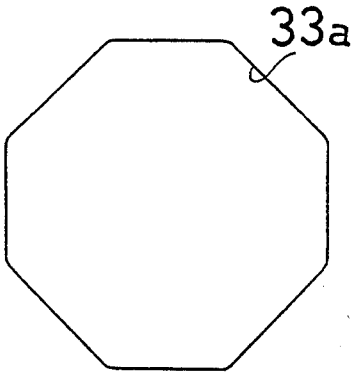

FIGS. 13*a* to 14 show a fifth embodiment, in which the bearing tip 31 in the female die 3 of the die assembly is block-shaped and has a central forming hole 36 as well as a bell-shaped recess 43 which smoothly continues to the bell-shaped hole through the backup block. This block 32 has on its rear side a comparatively deep recess 32*c* for tightly receiving the bearing tip. The other structural features are the same as the preceding embodiments, and therefore the abraded tip 31 can be replaced similarly in an easy and advantageous manner.

It will be understood that the central bore 33*a* formed through the cylindrical holder 33 for receiving the other members such as the backup block 32 may have its inner periphery of any noncircular contour as shown in FIGS. 15*a* to 15*f*, so long as it coincides with the outer periphery of said received members such as the backup block.

Although the bearing tip 31 and the backup block 32 are made of the hard metal, they may instead be formed with any other appropriate hard material such as a ceramics.

Figure 16:
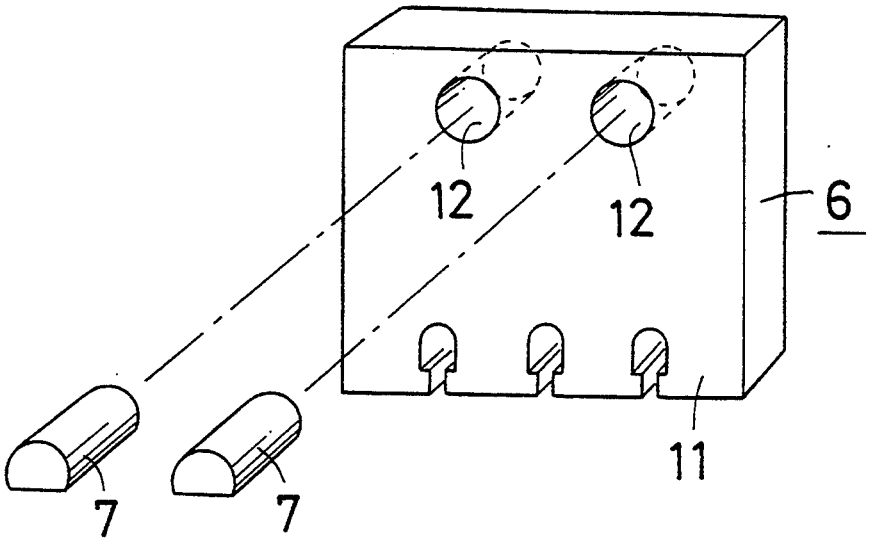
FIG. 16 is a perspective view showing the core supported in a modified manner.

In this embodiment partly shown in FIG. 16, a right and left openings 12 are formed through the core 6 so as to respectively receive the pins 7 supporting the core. Such a two-point support of said core is more stable and more reliable than the one-point support as in the foregoing embodiments. Instead, more than two openings may pierce the core for a much more reliable support thereof.

Although the core 6 in the male die 4 in the preceding embodiments has one or more pierced opening 12 which is penetrated by the stopping pin 7, said opening or openings may be replaced with one or more recesses in which one end of each pin is fitted, with another end thereof being protruding sideways.

What is claimed is:

1. An extrusion die comprising:

a bearing tip having such a forming hole as determining the outer periphery of an extruded article;

wherein the bearing tip is made of a thin flat plate having a thickness substantially corresponding to the bearing axial length of the central hole;

a supporting mold for holding the bearing tip in place, wherein the tip and the mold are separable from one another; and wherein the extrusion die for forming an outer periphery of an extruded article is combined with a male die for forming an inner periphery of the article;

wherein the male die comprises: a core having at its inner end at least one projected portion of such a shape as defining the inner periphery; the core further having at least one pierced opening through, or engraved recess on, a body of the core; at least one stopping member disposed through the opening or in the recess of the core such that at least one side end of the stopping member protrudes sideways from the side surface of the body; a male mold having a core-holding aperture which is formed through the male die so as to extend from an outer extremity to an inner extremity thereof; and at least one shoulder formed on an inner wall surface of the core-holding aperture so as to face the male dies' outer extremity disposed upstream of the extruded flow, wherein the core is inserted in the core-holding aperture such that the at least one side end of the stopping member is borne by the at least one shoulder so as to retain the core in the male mold.

2. An extrusion die as defined in claim 1, wherein the bearing tip is made of a hard material selected from a group consisting of a hard metal, a ceramics and the like.

3. An extrusion die as defined in claim 1, wherein the supporting mold is composed of at least one backup block and at least one cylindrical holder, wherein the cylindrical holder receives the bearing tip together with the backup block disposed behind and close to the bearing tip.

4. An extrusion die as defined in claim 3, wherein the backup block is made of a hard material selected from a group consisting of hard metal, a ceramics and the like.

5. An extrusion die as defined in claim 3, wherein the bearing tip has such a noncircular contour that the tip engages with an inner periphery of a tip receiving bore of the cylindrical holder and an angular position of the tip is not changed relative to the holder.

6. An extrusion die as defined in claim 3, wherein the bearing tip is set by pins in place relative to the backup block which is shrinkage-fitted in the cylindrical holder.

7. An extrusion die as defined in claim 3, wherein the backup block has on its rearward end surface a noncircular recess in which the bearing tip is secured.

8. An extrusion die comprising:

a bearing tip having such a central forming hole as determining an outer periphery of an extruded article;

wherein the bearing tip is made of a thin flat plate having a thickness substantially corresponding to the bearing axial length of the central hole;

a supporting mold for holding in place the bearing tip separable from the mold; and the supporting mold having a tip-insertion hold formed with a rearward opening and a forward bottom so that the bearing tip is inserted forwardly through said opening so as to rest on the bottom, wherein the tip-insertion hole comprises a guiding region extending forwards from the rearward opening and a gripping region which is formed as a forward end of said guiding region so as to tightly hold the inserted bearing tip, and wherein the guiding region has an inner periphery tapered such that its diameter reduces towards the gripping region which has a non-tapered inner periphery closely fittable on a non-tapered outer periphery of the bearing tip.

9. An extrusion die as defined in claim 8, wherein the supporting mold comprises a backup block in rear of the bearing tip, a metal-flow controlling spacer in front of the backup block, and a cylindrical holder for receiving said block together with said spacer, and wherein the rearward end surface of the backup block serves as the bottom of the tip-insertion hole, which hole is an axial bore through the metal-flow controlling spacer.

10. An extrusion die as defined in claim 9, wherein the bearing tip and the spacer are made of a hard material selected form a group consisting of a hard metal, a ceramics or the like.

11. An extrusion die comprising:

a bearing tip having such a central forming hole as determining an outer periphery of an extruded article;

a supporting mold for holding in place the bearing tip separable from the mold;

the supporting mold having a tip-insertion hole formed with a rearward opening and a forward bottom so that the bearing tip is inserted forwardly through said opening so as to rest on the bottom, wherein the tip-insertion hole comprises a guiding region extending forwards from the rearward opening and a gripping region which is formed as a forward end of said guiding region so as to tightly hold the inserted bearing tip, and wherein the guiding region has an inner periphery tapered such that its diameter reduces towards the gripping region which has a non-tapered inner periphery closely fittable on a non-tapered outer periphery of the bearing tip;

wherein the extrusion die for forming an outer periphery of an extruded article is combined with a male die for forming an inner periphery of the article, wherein the male die comprises: a core having at its inner end at least one projected portion of such a shape as defining the inner periphery; the core further having at least one pierced opening through, or engraved recess on, a body of the core; at least one stopping member disposed through the opening or in the recess of the core such that at least one side end of the stopping member protrudes sideways from the side surface of the body; a male mold having a core-holding aperture which is formed through the male die so as to extend from an outer extremity to an inner extremity thereof; and at least one shoulder formed on an inner wall surface of the core-holding aperture so as to face the male die's outer extremity disposed upstream of the extruded flow, wherein the core is inserted in the core-holding aperture such that the at least one side end of the stopping member is borne by the at least one shoulder so as to retain the core in the male mold.

12. An extrusion method for extruding an extrudable material to produce an extruded article comprising the steps of (1) providing an extrusion die comprising a bearing tip having such a forming hole as determining the outer periphery of an extruded article;

wherein the bearing tip is made of a thin flat plate having a thickness substantially corresponding to the bearing axial length of the central hole;

a supporting mold for holding the bearing tip in place, wherein the tip and the mold are separable from one another;

wherein the extrusion die for forming an outer periphery of an extruded article is combined with a male die for forming an inner periphery of the article, wherein the male die comprises: a core having at its inner end at least one projected portion of such a shape as defining the inner periphery; the core further having at least one pierced opening through, or engraved recess on, a body of the core; at least one stopping member disposed through the opening or in the recess of the core such that at least one side end of the stopping member protrudes sideways from the side surface of the body; a male mold having a core-holding aperture which is formed through the male die so as to extend from an outer extremity to an inner extremity thereof; and at least one shoulder formed on an inner wall surface of the core-holding aperture so as to face the male die's outer extremity disposed upstream of the extruded flow, wherein the core is inserted in the core-holding aperture such that the at least one side end of the stopping member is borne by the at least one shoulder so as to retain the core in the male mold; and (2) extruding said extrudable material through said extension die to produce said extruded article.

* * * * *